US008616794B2

(12) United States Patent
Kan et al.

(10) Patent No.: US 8,616,794 B2
(45) Date of Patent: Dec. 31, 2013

(54) RECORDING MEDIA TRANSPORTATION CONTROL METHOD AND PRINTER

(75) Inventors: So Kan, Matsumoto (JP); Yoshiki Ushiyama, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 531 days.

(21) Appl. No.: 12/883,559

(22) Filed: Sep. 16, 2010

(65) Prior Publication Data

US 2011/0081190 A1 Apr. 7, 2011

(30) Foreign Application Priority Data

Oct. 7, 2009 (JP) ..... 2009-233070

(51) Int. Cl.
*B41J 11/00* (2006.01)

(52) U.S. Cl.
USPC ..... 400/621; 400/621.2

(58) Field of Classification Search
USPC ..... 400/621
See application file for complete search history.

(56) References Cited

U.S. PATENT DOCUMENTS 4,090,118 A * 5/1978 Smith, Jr. ..... 318/567
5,026,183 A * 6/1991 Oshima et al. ..... 400/605
7,597,493 B2 * 10/2009 Mori et al. ..... 400/621
7,726,893 B2 * 6/2010 Harada et al. ..... 400/615.2
8,303,198 B2 * 11/2012 Nishimura et al. ..... 400/76
2001/0000222 A1 * 4/2001 Miyazaki et al. ..... 400/621
2003/0033915 A1 * 2/2003 Glemser et al. ..... 83/26
2005/0253886 A1 * 11/2005 Nakajima et al. ..... 347/16
2006/0005722 A1 * 1/2006 Nobukawa et al. ..... 101/181

FOREIGN PATENT DOCUMENTS

JP 2004-249476 A 9/2004
JP 2004-345210 A 12/2004
JP 2007-320134 A 12/2007

* cited by examiner

*Primary Examiner* — Anthony Nguyen
(74) *Attorney, Agent, or Firm* — Nutter McClennen & Fish LLP

(57) ABSTRACT

In a printer that prints to continuous paper, starting to back-feed the recording paper for printing the next print job before the user cuts the previously printed page can be prevented. The printer prints while conveying recording paper delivered from fanfold paper through a transportation path, and after printing cuts the recording paper using a cutter disposed near the paper exit. When printing ends, the control unit positions the perforation at the trailing end of the printed page to a cutting position, and sets a tear-off state holding the recording paper where positioning was completed. When new print data is received while in the tear-off state, the recording paper transportation operation is prohibited and the tear-off state is continued until a preset delay time passes. When the delay time has passed, the recording paper is immediately fed back and indexed for the next print job.

20 Claims, 3 Drawing Sheets

RECORDING MEDIA TRANSPORTATION CONTROL METHOD AND PRINTER

BACKGROUND

1. Technical Field

The present invention relates to a printer that prints on a web of recording media, and relates more particularly to a printer and a method of controlling transportation of the recording medium whereby the recording medium cutting position can be advanced to the cutter position for cutting after printing, and can then reverse the recording medium so that the next printing start position can be positioned to the printing position of the print head for the next print job.

2. Related Art

Recording media used for printing by a printer include roll paper having a web of recording paper wound into a paper roll, and fanfold paper, which has perforations formed in the recording paper for tearing the recording paper into individual pages with the pages folded at the perforations into a stack. With printers that use fanfold paper, the user normally presses a switch after printing is completed to advance the perforation at the trailing end of the last printed page to the cutting position of the cutter, and then cuts (tears) the paper. Another switch is then pressed to backfeed the paper and index the beginning of the printing area on the next page to the printing position of the print head in preparation for the next print job.

When roll paper is used, the target cutting position following the printed portion of the roll paper is similarly advanced to the cutting position of the cutter, the recording paper is cut, and the recording paper is then backfed in preparation for the next print job.

Japanese Unexamined Patent Appl. Pub. JP-A-2007-320134 teaches a printer that prints on fanfold paper and roll paper. The printer taught in JP-A-2007-320134 executes a tear-off operation whereby the target cutting position at the trailing end of the printed page is automatically advanced to and held at the cutting position after printing ends. With this configuration the user does not need to manually advance the recording paper to the cutting position, and can easily cut the recording paper by tearing the printed paper that was automatically advanced to the cutting position, or working a cutter lever to cut the paper.

The recording paper is then left at this advanced position after the user cuts the recording paper, and when the next print job is received, the printer taught in JP-A-2007-320134 automatically backfeeds and resets the recording paper from the cutting position to the printing position of the print head.

When a printer that automatically backfeeds the recording paper when print data is received after the tear-off operation described above is used by multiple users, and print data is received from a second user immediately after the print job from a first user is finished and the tear-off operation is executed, backfeeding the recording paper may start before the first user can tear off the page printed for the first print job. Cutting the printed page before the next print job starts may therefore not be possible. Further possibly, the backfeed operation may start while the first user is cutting the paper, possibly resulting in a paper jam or the recording paper being cut at a position other than the perforation or the intended cutting position. This same problem can occur when a single user sends plural print jobs.

SUMMARY

A printer and a recording medium transportation control method according to the present invention can reduce problems resulting from backfeeding the recording paper before the user cuts the printed page in a printer that executes a tear-off operation when a print job is completed.

A first aspect of the invention is a recording media transportation control method for a printer that conveys a recording medium web through a transportation path and enables cutting the recording medium using a cutting means on the downstream side of the printing position of a printing means on the transportation path, whereby: the printer executes a positioning operation that conveys and positions an target cutting position of the cutting means on the recording medium to a cutting position on the transportation path when printing ends, and then waits in the positioned state after completion of the printing operation, and when print data is received in this positioned state, continues holding the positioned state until a preset delay time passes after the print data is received.

With this aspect of the invention, when new print data is received in the positioned state, the positioned state is held until a preset delay time passes. As a result, backfeeding the recording medium does not start immediately even if the next print data is received immediately after one print job ends, and the recording medium can be held at the position where cutting is possible for at least the delay time. Starting the transportation operation for the next print job before the user cuts the printed portion of the recording medium or while cutting the recording medium can therefore be suppressed. When plural users share a single printer, the convenience of the paper cutting operation can be improved for each user. Problems resulting from starting printing the next page before the previously printed page is cut can also be reduced. The same problems can also be reduced when a single user sends plural print jobs.

In another aspect of the invention, when the print data is received in the positioned state, a reset operation that conveys and returns a printing start position on the recording medium to the printing position preferably executes after the delay time has passed.

By resetting the printing position after the delay time has passed, time for the user to cut the paper can be assured while also indexing the recording medium for the next print job (conveying the next printing start position on the recording medium to the position of the printing means). The next print job can therefore be started quickly.

Further preferably, the reset operation starts when an operating means disposed to the printer is operated, or a reset command from a host device connected to the printer is input, while in the positioned state.

For example, the reset operation can be operating a manual start switch for the positioning operation on the printer. This configuration enables the user to end the positioned state and start the reset operation as necessary during the delay (standby) period. There is therefore no need to wait for the delay time to pass when the user quickly cuts the recording medium, for example, and the next print job can be started quickly.

Yet further preferably in another aspect of the invention, the positioned state continues until a cancel extension operation of the operating means is performed, or a cancel extension command is input from the host device when an extend operation of the operating means is performed, or an extend command is input from the host device, in the positioned state.

Because the user can extend the positioned state for as long as may be necessary with this aspect of the invention, the printer can be made to wait in the positioned state for the desired time, such as when the user does not cut the recording medium soon. The positioned state can then be ended at the desired timing by means of the cancel extension operation or cancel extension command to prepare for the next print job.

The extend operation may be operating a pause printing switch disposed to the printer, and the cancel extension operation may be operating a manual start switch for the positioning operation disposed to the printer. Because a printing pause an extension will not occur at the same time, a single switch can be used for both operations. In addition, because manually starting the positioned state and canceling the extension will not occur simultaneously, a single switch can be used for both operations. The parts count can therefore be reduced by this configuration.

Further preferably in another aspect of the invention, one of a plurality of operating modes including a first operating mode and a second operating mode can be selectively set as the printer operating mode, the first operating mode continuing the positioned state until the delay time passes from when print data is received in the positioned state, and the second operating mode returning the printing start position on the recording medium to the printing position when print data is received in the positioned state.

This aspect of the invention enables selectively setting whether or not a delay time is used. Therefore, the first operating mode can be set when multiple users use a single printer, and cutting the printed pages can be made more convenient for each user. On the other hand, by setting the second operating mode when the printer is used by a single user, printing process delays resulting from setting a delay time can be reduced.

In another aspect of the invention, the positioning operation is executed based on a positioning start command input from the host device.

With this configuration there is no need to determine on the printer side if positioning conditions are set. Printer-side control is therefore not made more complicated.

Further preferably in another aspect of the invention, the printer sounds at least one of the execution timing of the positioning operation, the timing of a transition to the delay period, the timing when the positioned state ends, and the timing when the positioned state is extended.

With this aspect of the invention the user can be informed that the printed page can be cut and prompted to cut the paper, and the cutting operation can be completed quickly. In addition, the user can be made aware that the delay time has started and prompted to cut the paper, and failure to finish cutting the paper during the delay period can be reduced. Furthermore, by informing the user that the positioned state has been extended, or that the delay time is over and the paper will be indexed for the next print job, the user can act according to the conditions and wasted action can be eliminated.

Another aspect of the invention is a printer including a transportation means that conveys a recording medium web through a transportation path; a printing means that prints on the recording medium at a printing position on the transportation path; a cutting means that can cut the recording medium at a cutting position on the transportation path; and a control unit that executes the recording medium transportation control method described above.

Effect of the Invention

With the invention thus described, backfeeding the recording medium does not start immediately even if the next print data is received immediately after one print job ends, and the recording medium can be held at the position where cutting is possible for at least the delay time. Starting the transportation operation because of the next print job before the user cuts the printed portion of the recording medium or while cutting the recording medium can therefore be suppressed. When plural users share a single printer, the convenience of the paper cutting operation can be improved for each user. Problems resulting from starting printing the next page before the previously printed page is cut can also be reduced. The same problems can also be reduced when a single user sends plural print jobs.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a printer and a method of controlling recording media transportation in the printer according to the present invention is described below with reference to the accompanying figures.

General Configuration of the Printer

Figure 1:
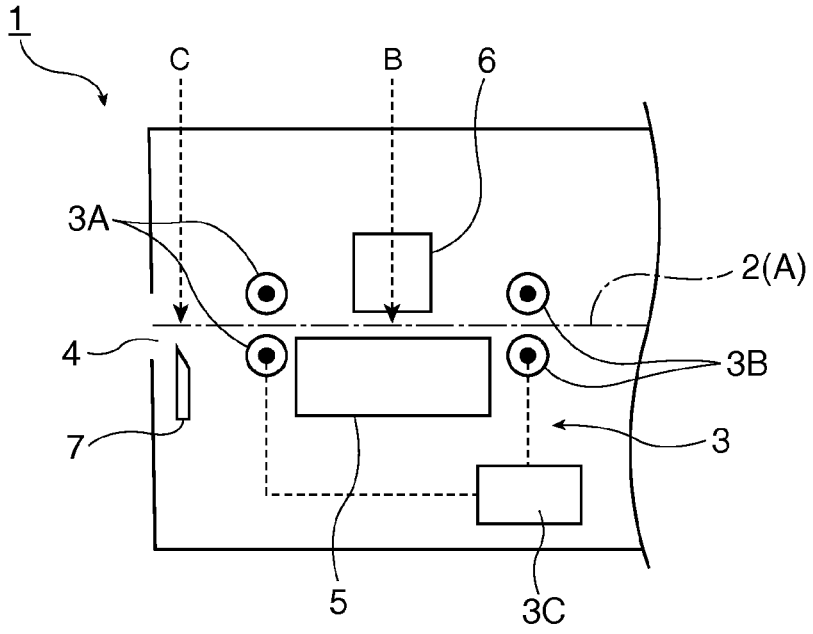
FIG. 1 schematically describes the main parts of a printer in which the invention is applied.

FIG. 1 schematically describes the main parts of a printer with a cutter according to this embodiment of the invention.

The 1 has a recording paper loading compartment (not shown in the figure) for holding fanfold paper of pages separated by perforations at a predetermined interval folded into a stack. The recording paper 2 delivered from the loaded fanfold paper is conveyed by a transportation mechanism 3 (transportation means) through the transportation path A inside the printer 1 (the path indicated by the dot-dash line denoting the recording paper 2), and is discharged from the paper exit 4.

A platen 5 and recording head 6 (printing means) are disposed opposite each other on the transportation path A, and the printing position B on the recording paper 2 is determined by the platen 5 and recording head 6.

The recording head 6 in this embodiment of the invention is a serial impact dot matrix (SIDM) print head that prints by driving recording wires against an ink ribbon to transfer ink from the ink ribbon to the recording paper 2. Note that the recording head 6 is not so limited and may be an inkjet head or a head for another type of printing method.

The transportation mechanism 3 has paper feed roller pairs 3A and 3B that grip the recording paper 2 at two locations, before and after the platen 5. By synchronously driving these paper feed roller pairs 3A and 3B forward and reverse by means of a transportation motor 3C, the recording paper 2 is conveyed in a forward direction and a reverse direction.

A cutter 7 (paper cutting means) is disposed to the transportation path A near the paper exit 4, and the cutter 7 determines the cutting position C of the recording paper 2. The cutter 7 in this embodiment of the invention is a manual cutter (a tear-off bar) disposed with the cutting edge facing the recording paper 2 on the transportation path A. The user can cut the recording paper 2 widthwise at the cutting position C by holding the printed page discharged from the paper exit 4 and pulling the recording paper 2 to the side pressing the recording paper 2 against the cutting edge of the cutter 7.

Note that the cutter 7 may be a scissor cutter having a movable knife and a fixed knife configured to drive the movable knife by operating a cutter operating lever disposed to the outside case of the printer 1. With this configuration the recording paper 2 can be cut widthwise at the cutting position C by means of the user operating the cutter operating lever with the recording paper 2 positioned to the cutting position C.

Figure 2:
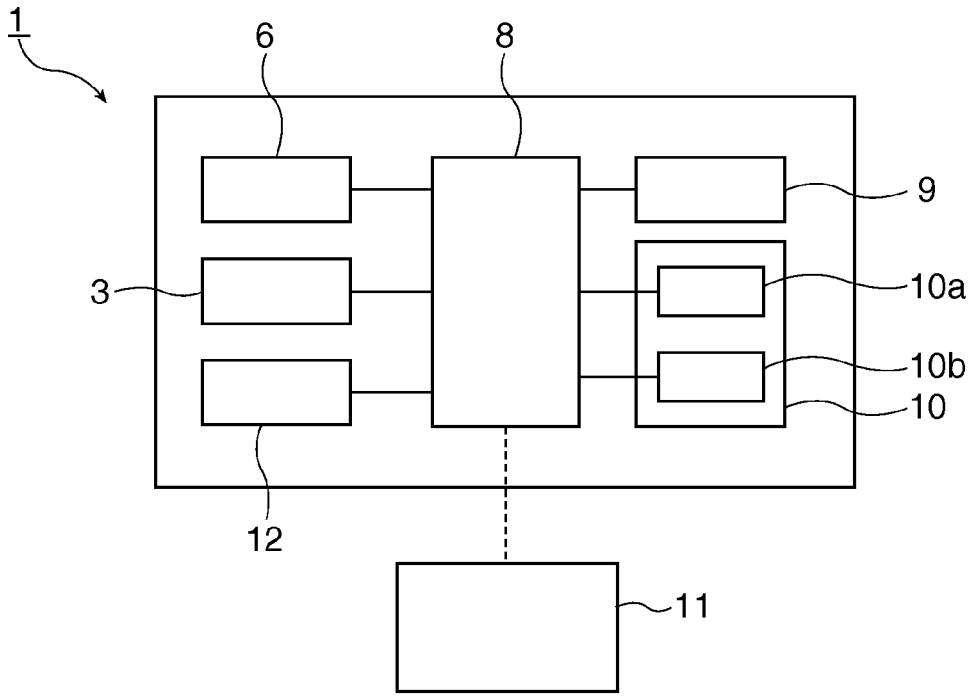
FIG. 2 is a schematic block diagram showing the control system of the printer.

FIG. 2 is a block diagram showing the control system of the printer. The control system includes a control unit 8 built around an MPU including a CPU, ROM, and RAM. Detection signals from a sensor group 9 including a recording paper sensor disposed to the transportation path A, and an open/close sensor that detects whether the printer 1 cover is open or closed, are supplied to the control unit 8. Operating signals from an operating unit 10 disposed to the outside case of the printer 1, for example, are also supplied to the control unit 8. Print data and commands from a host device 11 that is connected directly to the printer 1 or communicates with the printer 1 are also supplied to the control unit 8. The control unit 8 controls the parts of the printer 1 based on these detection signals, operating signals, and print data.

When executing a print job, the control unit 8 drives the recording head 6 and the carriage on which the recording head 6 is mounted synchronized to recording paper 2 transportation to control the printing operation in each print job based on the print data supplied from the host device 11.

A pause switch 10*a* (pause printing switch) is disposed to the operating unit 10 (operating means) of the printer 1. When an operating signal indicating that the pause switch 10*a* was pressed during a printing operation is supplied, the control unit 8 stops the recording head 6 and transportation mechanism 3 and pauses the printing operation.

A tear-off switch 10*b*, which is a switch for manually starting the tear-off operation, is also disposed to the operating unit 10. The tear-off switch 10*b* is a switch enabling the user to start the tear-off operation described below at a desired timing.

A buzzer 12 is also disposed to the printer 1, and the control unit 8 controls sounding the buzzer 12 at specific times.

Controlling Recording Paper Transportation after a Print Job Ends

Figure 3A:
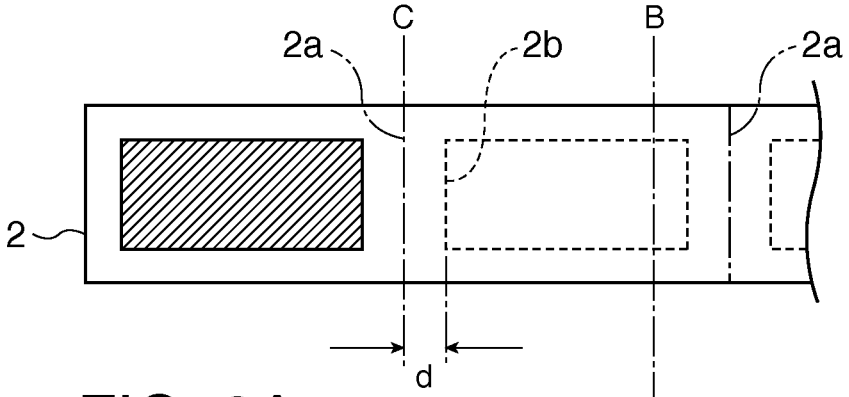
FIG. 3A and FIG. 3B describe the tear-off operation (when positioned) and indexing operation.
Figure 3B:
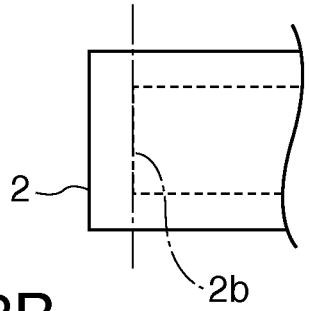

FIG. 3A shows the state when the target cutting position of the recording paper is positioned to the cutting position of the cutter (the tear-off state (positioned state)), and FIG. 3B shows the state when the printing start position of the recording paper is positioned (indexed) to the printing position of the recording head.

The printer 1 according to this embodiment of the invention automatically starts the tear-off operation (positioning operation) without delay when a print job ends, positions the perforation 2*a* at the trailing end of the printed page to the cutting position C as shown in FIG. 3A, and forms the tear-off state in which the recording paper 2 is held at this position. If the user cuts the recording paper 2 in this tear-off state, the paused recording paper 2 can be easily and accurately cut at the target cutting position.

In this embodiment of the invention a plurality of reset tear-off conditions for enabling transportation of the recording paper 2 by the transportation mechanism 3 when the formed tear-off state is completed are previously stored in the memory of the control unit 8. Which of these plural reset tear-off conditions is used is preset as the operating mode of the printer 1.

The operating mode can be set according to a setup command from the host device 11, but the operating mode could alternatively be set using a memory switch disposed to the printer 1, for example. When the tear-off operation is executed, the control unit 8 reads the reset tear-off condition for the set operating mode from memory, and ends the tear-off state according to the reset condition. One of two operating modes, a first operating mode and a second operating mode, described below can be selected and set in this embodiment of the invention.

First Operating Mode

The first operating mode sets a predetermined delay time after new print data is received in the tear-off state as the reset tear-off condition. Performing a specific reset tear-off operation during this tear-off state, including the delay period, and inputting a reset tear-off command from the host device 11, can also be used as the reset tear-off condition. The delay period of the first operating mode can be set anywhere in the range from 1 second to 30 seconds when setting the operating mode. Note that if the delay time is set to the default value when the first operating mode is selected, the delay time can be automatically set to the default value.

Figure 4:
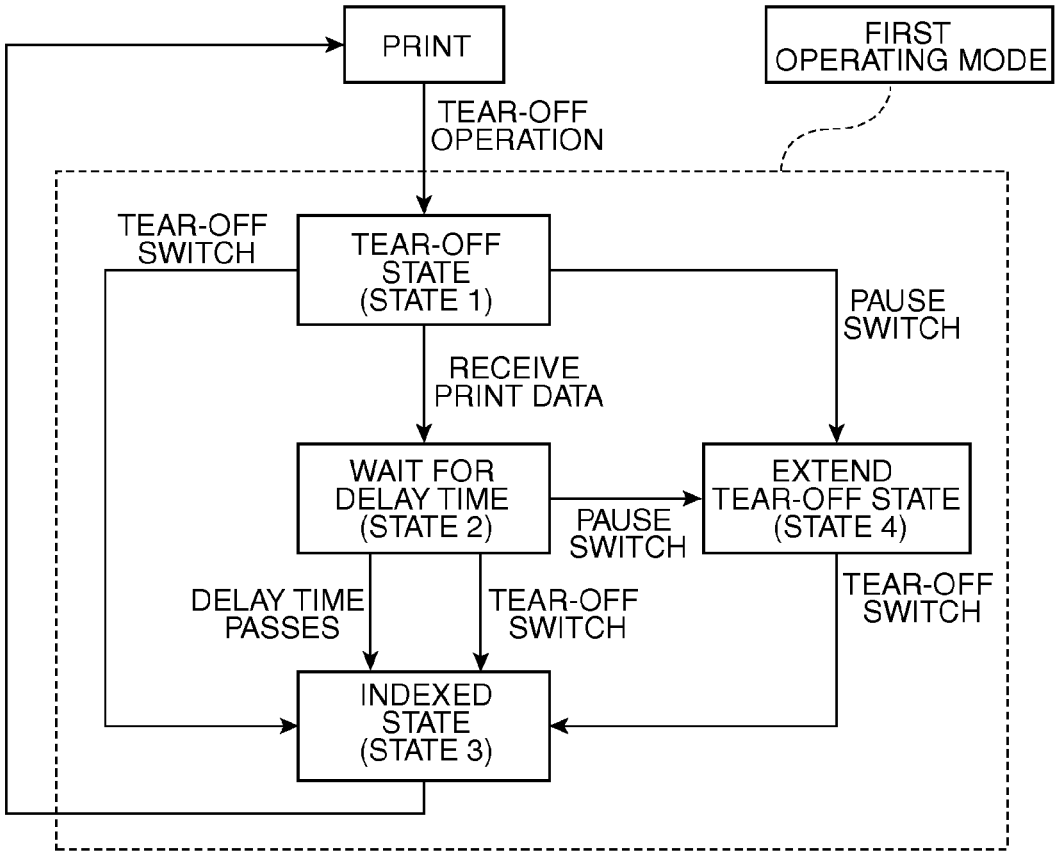
FIG. 4 is a state transition diagram of the printer in first operating mode.

FIG. 4 is a printer state transition chart in the first operating mode. Each time a print job ends in the first operating mode, the control unit 8 starts the tear-off operation without delay and goes to the tear-off state (state 1) based on a start tear-off command received with the print data, or a start tear-off command input from the host device 11 based on completion of the print job. Note, also, that a control program, that sets completion of a print job as the condition for starting the tear-off operation can be stored in the memory of the control unit 8, and the tear-off operation may be started based on this control program.

If new print data is received from the host device 11 when in the tear-off state, the control unit 8 blocks the recording paper 2 transportation operation and enters a standby state (state 2) in which the tear-off state continues. In the standby state the control unit 8 monitors the time passed since the print data was received, and when the set delay time passes cancels the standby state and starts an automatic reset operation that indexes the recording paper 2 in preparation for the next print job.

This automatic reset operation is a transportation operation in which the recording paper 2 is backfed and the recording paper 2 is conveyed in reverse until the printing start position 2*b* (See FIG. 3A and FIG. 3B) of the next page after the printed page is reversed to the printing position B. As shown in FIG. 3A, the printing start position 2*b* is length d, which is the top margin of each page, behind the perforation 2*a*, which is the trailing end of the printed page. With completion of the automatic reset operation, the printer 1 is in the indexed state (state 3) where printing on the recording paper 2 can start without delay.

Before a print job is received (state 1) and when in the standby state after a print job is received (state 2) when in the first operating mode, the tear-off state is terminated immediately and the automatic reset operation starts when a specific reset tear-off operation occurs or when a reset tear-off command is input from the host device 11. In this embodiment of the invention the reset tear-off operation is pressing the tear-off switch 10*b*. More specifically, when an operating signal indicating that the tear-off switch 10*b* was pressed is supplied or when a reset tear-off command is received while in the standby period, the control unit 8 ends the tear-off state before the delay period is over and immediately starts the automatic reset operation to set the indexed state (state 3) so that printing is enabled.

Furthermore, an extend tear-off condition for continuing the tear-off state indefinitely is also set in the first operating mode, and once extended the tear-off state continues until a specific cancel extended tear-off condition is satisfied. In this embodiment of the invention the extend tear-off condition is the pause switch 10*a* being pressed or input of an extend tear-off command from the host device 11. The cancel extended tear-off condition is the tear-off switch 10*b* being pressed, or input of a cancel extended tear-off command from the host device 11.

Before a print job is received (state 1) and in the standby period after receiving a print job (state 2), the control unit 8 enters an indefinite extended tear-off state (state 4) when an operating signal indicating the pause switch 10*a* was pressed is supplied or when an extend tear-off command is received. Because recording paper 2 transportation operations, including the automatic reset operation, are prohibited in this extended tear-off state, the control unit 8 cannot index the recording paper 2 and cannot print. This extended tear-off state is cancelled based on receipt of an operating signal indicating the tear-off switch 10*b* was pressed or the cancel extended tear-off command. After being cancelled, the automatic reset operation is executed immediately, the paper is indexed (state 3), and printing is enabled.

In the first operating mode the control unit 8 sounds the buzzer 12 in conjunction with the tear-off operation to inform the user that the tear-off state (state 1) was entered. The buzzer 12 can also be sounded at transitions between states 1 to 4 to inform the user that the control state of the printer 1 changed. More specifically, when print data is received and the standby mode is entered (transition from state 1 to state 2), when the delay period passes and the automatic reset operation starts (transition from state 2 to state 3), when the automatic reset operation starts because the tear-off switch 10*b* was pressed (transition from state 1 or 2 to state 3), when the extended tear-off state is entered because the pause switch 10*a* was pressed (transition from state 1 or 2 to state 4), and when the pause switch 10*a* is pressed again to cancel the extended tear-off state (transition from state 4 to state 3), the buzzer 12 is sounded.

As described above, in the first operating mode of the printer 1, the transportation mechanism 3 is not driven immediately when a print job is received, and the recording paper 2 remains stationary for the duration of a delay time. As a result, when plural users share the printer 1, backfeeding the recording paper 2 for indexing when a second user sends print data before a first user finishes cutting their own printed page can be suppressed, and usability can be improved for each user. In addition, the tear-off state can be ended or extended as necessary by operating a pause switch 10*a* or tear-off switch 10*b* or sending an appropriate command from the host device 11. As a result, the delay time can be shortened to suppress a delay in the printing process as needed, and the timing of the start of the next print job can be changed according to the convenience of the user.

Second Operating Mode

The reset tear-off conditions of the second operating mode are supplying a tear-off switch 10*b* operating signal to the control unit 8 (that a reset tear-off operation will be executed), inputting a reset tear-off command from the host device 11, or receiving new print data. As in the first operating mode, the tear-off operation executes automatically and the tear-off state is entered when a print job is completed in the second operating mode. The tear-off state of the second operating mode continues indefinitely until the above-described reset tear-off conditions are satisfied, and when the reset conditions are satisfied, the foregoing automatic reset operation starts immediately.

More specifically, because a delay time is not set in the second operating mode, the automatic reset operation can start without delay when a new print job is received similarly to the related art. In addition, as in the first operating mode, because the buzzer 12 sounds at state transitions in the second operating mode, such as executing the tear-off operation or starting the automatic reset operation, the user's attention be attracted at the appropriate time.

By presetting the operating mode in the printer 1 as described above, whether a delay time is inserted or not can be selected. As a result, by setting the first operating mode when the printer 1 is used by multiple users, the convenience of cutting the printed page can be improved for each user. In addition, when a single user uses the printer 1, printing process delays can be reduced if the second operating mode is set to set the delay time.

Other Embodiments (1) The embodiment described above uses fanfold paper as the recording paper 2, but transportation can be controlled in the same way when using roll paper or other type of continuous recording paper 2. Paper with perforations is not required.

(2) The embodiment described above notifies the user of state transitions related to the tear-off operation and the tear-off state by means of a buzzer 12, but a tear-off indicator may be disposed to the printer 1, and the user can be informed of tear-off operations and state transitions related to the tear-off state by turning the tear-off indicator on.

(3) One of two operating modes, a first operating mode and a second operating mode, is selectively set in the embodiment described above, but other operating modes are also conceivable, and the operating mode could be selected from among three or more operating modes. An example of another operating mode is an operating mode in which the tear-off operation is not executed when printing ends, and the tear-off operation executes only when the tear-off switch 10*b* is pressed. This enables manually separating the pages at the perforations at one time after printing a plurality of print jobs.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A recording media transportation control method for a printer comprising:

executing a positioning operation that conveys a recording medium to a positioned state, wherein a printer conveys a target cutting position on the recording medium to a cutting position of a cutting means on a transportation path when a printing operation ends, waiting in the positioned state after completion of the printing operation, and when print data is received while the recording medium is in the positioned state, continuing to hold the recording medium in the positioned state until a preset delay time passes after the print data is received.

2. The recording media transportation control method described in claim 1, wherein:

when the print data is received in the positioned state, a reset operation that conveys and returns a printing start position on the recording medium to a printing position executes after the delay time has passed.

3. The recording media transportation control method described in claim 2, wherein:

the reset operation starts when an operating means disposed to the printer is operated, or a reset command from a host device connected to the printer is input, while in the positioned state.

4. The recording media transportation control method described in claim 3, wherein:

when an extend operation of the operating means is performed, or an extend command is input from the host device, in the positioned state, the recording medium remains in the positioned state until a cancel extension operation of the operating means is performed, or a cancel extension command is input from the host device.

5. The recording media transportation control method described in claim 1, wherein:

one of a plurality of operating modes including a first operating mode and a second operating mode is selectively set as the printer operating mode, the first operating mode continuing the positioned state until the delay time passes from when print data is received in the positioned state, and the second operating mode returning a printing start position on the recording medium to a printing position when print data is received in the positioned state.

6. The recording media transportation control method described in claim 1, wherein:

the positioning operation is executed based on a positioning start command input from the host device.

7. The recording media transportation control method described in claim 1, wherein:

the printer sounds an audible signal when at least one of (1) the positioning operation is executed, (2) the print data is received and the printer continues holding in the positioned state for the preset delay time, (3) the preset delay time ends, (3) an automatic reset begins after the print data is received, and (4) the positioned state is extended.

8. A printer comprising:

a transportation means that conveys a recording medium web through a transportation path;

a printing means that prints on the recording medium at a printing position on the transportation path;

a cutting means that can cut the recording medium at a cutting position on the transportation path; and a control unit that controls the printer to execute a positioning operation that conveys the recording medium to a positioned state wherein the printer conveys a target cutting position on the recording medium to a cutting position of the cutting means on the transportation path, and waits in the positioned state after completion of the positioning operation, and when print data is received when the recording medium is in the positioned state, continues holding the recording medium in the positioned state until a preset delay time passes after the print data is received.

9. The printer described in claim 8, wherein:

when the print data is received in the positioned state, the control unit executes a reset operation after the delay time has passed, wherein the reset operation conveys and returns a printing start position on the recording medium to the printing position.

10. The printer described in claim 8, further comprising:

an operating means disposed to the printer and a host device connected to the printer, wherein when the operating means is operated or when a reset command from the host device is input, a reset operation starts while in the positioned state.

11. The printer described in claim 8, further comprising:

an operating means disposed to the printer and a host device connected to the printer, wherein when an extend operation of the operating means is performed, or an extend command is input from the host device, in the positioned state, the positioned state continues until a cancel extension operation of the operating means is performed, or a cancel extension command is input from the host device.

12. The printer described in claim 8, wherein:

one of a plurality of operating modes including a first operating mode and a second operating mode is selectively set as a printer operating mode, the first operating mode continuing the positioned state until the delay time passes from when print data is received in the positioned state, and the second operating mode returning a printing start position on the recording medium to a printing position when print data is received in the positioned state.

13. The printer described in claim 8, wherein:

the positioning operation is executed based on a positioning start command input from a host device.

14. The recording media transportation control method described in claim 1, wherein, the preset delay time is set in the range from approximately 1 second to approximately 30 seconds.

15. A printer comprising:

a paper feed roller that conveys a recording medium web through a transportation path;

a recording head that prints on the recording medium at a printing position on the transportation path;

a cutter that can cut the recording medium at a cutting position on the transportation path; and a control unit that controls the printer to execute a positioning operation that conveys a target cutting position on the recording medium to a cutting position of the cutter on the transportation path, and waits in a positioned state after completion of the positioning operation, and when print data is received when the recording medium is in the positioned state, continues holding the recording medium in the positioned state until a preset delay time passes after the print data is received.

16. The printer described in claim 15, wherein:

when the print data is received in the positioned state, the control unit executes a reset operation after the delay time has passed, wherein the reset operation conveys and returns a printing start position on the recording medium to the printing position.

17. The printer described in claim 15, further comprising:

an operating unit disposed to the printer and a host device connected to the printer, wherein when the operating unit is operated or when a reset command from the host device is input, a reset operation starts while in the positioned state.

18. The printer described in claim 15, further comprising:

an operating unit disposed to the printer and a host device connected to the printer, wherein when an extend operation of the operating unit is performed, or an extend command is input from the host device, in the positioned state, the positioned state continues until a cancel extension operation of the operating unit is performed, or a cancel extension command is input from the host device.

19. The printer described in claim 15, wherein:

one of a plurality of operating modes including a first operating mode and a second operating mode is selectively set as a printer operating mode, the first operating mode continuing the positioned state until the delay time passes from when print data is received in the positioned state, and the second operating mode returning a printing start position on the recording medium to a printing position when print data is received in the positioned state.

20. The printer described in claim 15, wherein:

the positioning operation is executed based on a positioning start command input from a host device.

* * * * *